US007396116B2

(12) United States Patent
Yazawa

(10) Patent No.: US 7,396,116 B2
(45) Date of Patent: Jul. 8, 2008

(54) INK JET PRINTER HAVING SPARE INK CARTRIDGES

(75) Inventor: Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 328 days.

(21) Appl. No.: 11/214,897

(22) Filed: Aug. 31, 2005

(65) Prior Publication Data

US 2006/0044366 A1 Mar. 2, 2006

(30) Foreign Application Priority Data

Aug. 31, 2004 (JP) ..... 2004-252998

(51) Int. Cl.
*B41J 2/175* (2006.01)
*B41J 2/17* (2006.01)

(52) U.S. Cl. ..... 347/86; 347/84

(58) Field of Classification Search ..... 347/84, 347/86
See application file for complete search history.

(56) References Cited

FOREIGN PATENT DOCUMENTS

| | | | |
|---|---|---|---|
| JP | 8169121 | | 7/1996 |
| JP | 8281928 | | 10/1996 |
| JP | 08281928 | A * | 10/1996 |
| JP | 2000351220 | * | 12/2000 |

* cited by examiner

*Primary Examiner*—Stephen D. Meier
*Assistant Examiner*—Carlos A Martinez, Jr.
(74) *Attorney, Agent, or Firm*—Banner & Witcoff, Ltd

(57) ABSTRACT

An ink jet printer is provided with an ink jet head, a first support device, and a connecting device. The ink jet head is connected with an ink cartridge that stores ink, and the ink jet head discharges the ink supplied from the ink cartridge. The first support device is capable of supporting a plurality of spare ink cartridges that are aligned in a direction in which the ink is discharged. The connecting device disconnects the ink cartridge from the ink jet head, and connects one of the spare ink cartridges to the ink jet head. In the ink jet printer, the first support device is offset from the ink jet head within a plane that is perpendicular to the direction of ink discharge.

17 Claims, 14 Drawing Sheets

INK JET PRINTER HAVING SPARE INK CARTRIDGES

CROSS-REFERENCE TO RELATED APPLICATION

This application claims priority to Japanese Patent Application No. 2004-252998, filed on Aug. 31, 2004, the contents of which are hereby incorporated by reference into the present application.

BACKGROUND OF THE INVENTION

1. Field of the Invention

The present invention relates to an ink jet printer.

2. Description of the Related Art

Ink jet printers are well known. Ink jet printers are provided with an ink jet head connected with an ink cartridge. Ink is supplied to the ink jet head from the ink cartridge. The ink jet head discharges the ink that has been supplied from the ink cartridge towards a print medium. As a result, printing or drawing against the print medium is performed.

Some ink jet printers can store a spare ink cartridge. With this type of printer, when the ink runs out in the ink cartridge connected with the ink jet head, the used ink cartridge is removed from the ink cartridge, and the spare ink cartridge is connected with the ink jet head. Printing or drawing can then be performed using the spare ink cartridge. This type of ink jet printer is taught in, for example, Japanese Patent Application Publication No. H08-169121.

In the case of the conventional ink jet printer described above, only one spare ink cartridge can be stored. While the spare ink cartridge is being connected with the ink jet head, a user of the printer removes the used ink cartridge, and houses a new spare ink cartridge within the printer. This ink cartridge exchange operation is troublesome. In the conventional ink jet printer, the user must perform the ink cartridge exchange operation frequently. An ink jet printer is desirable in which the user has to perform the ink cartridge exchange operation less frequently.

BRIEF SUMMARY OF THE INVENTION

If a plurality of spare ink cartridges is housed within a printer, used ink cartridges can be exchanged into new spare ink cartridges as a whole. Therefore, the ink cartridge exchange operation can be performed less frequently. However, a large space is needed within the printer so as to house the plurality of spare ink cartridges. If the spare ink cartridges are disposed with no consideration, the printer will become larger.

The present invention has been created taking the aforementioned situation into consideration. That is, an ink jet printer is presented that is capable of housing a plurality of spare ink cartridges, and that is small in size.

An ink jet printer taught in the present specification is provided with an ink jet head, a first support device, and a connecting device. The ink jet head is connected with an ink cartridge that stores ink, and the ink jet head discharges the ink supplied from this ink cartridge. The first support device is capable of supporting a plurality of spare ink cartridges that are aligned in a direction in which the ink is discharged form the ink jet head. The ink cartridge which is currently connected with the ink jet head is disconnected from the ink jet head by the connecting device. The connecting device connects one of the spare ink ridges, which are being supported by the first support device, to the ink jet head. In the ink jet printer, the first support device is offset from the ink jet head within a plane that is perpendicular to the direction of ink discharge.

In this ink jet printer, the spare ink cartridges are aligned in the direction of ink discharge. Since the ink jet head and the first support device are offset, the spare ink cartridges can be housed using the space that the thickness of the ink jet head requires.

The ink jet printer can house the spare ink cartridges using the space that is already required. The ink jet printer can house the plurality of spare ink cartridges, and yet be small in size.

BRIEF DESCRIPTION OF THE DRAWINGS

FIG. 8(*b*) shows a state while ate ink cartridge is being exchanged.

FIG. 9(*b*) shows a state where a rack member is moving towards the right.

DETAILED DESCRIPTION OF THE INVENTION

First Embodiment

Figure 1:
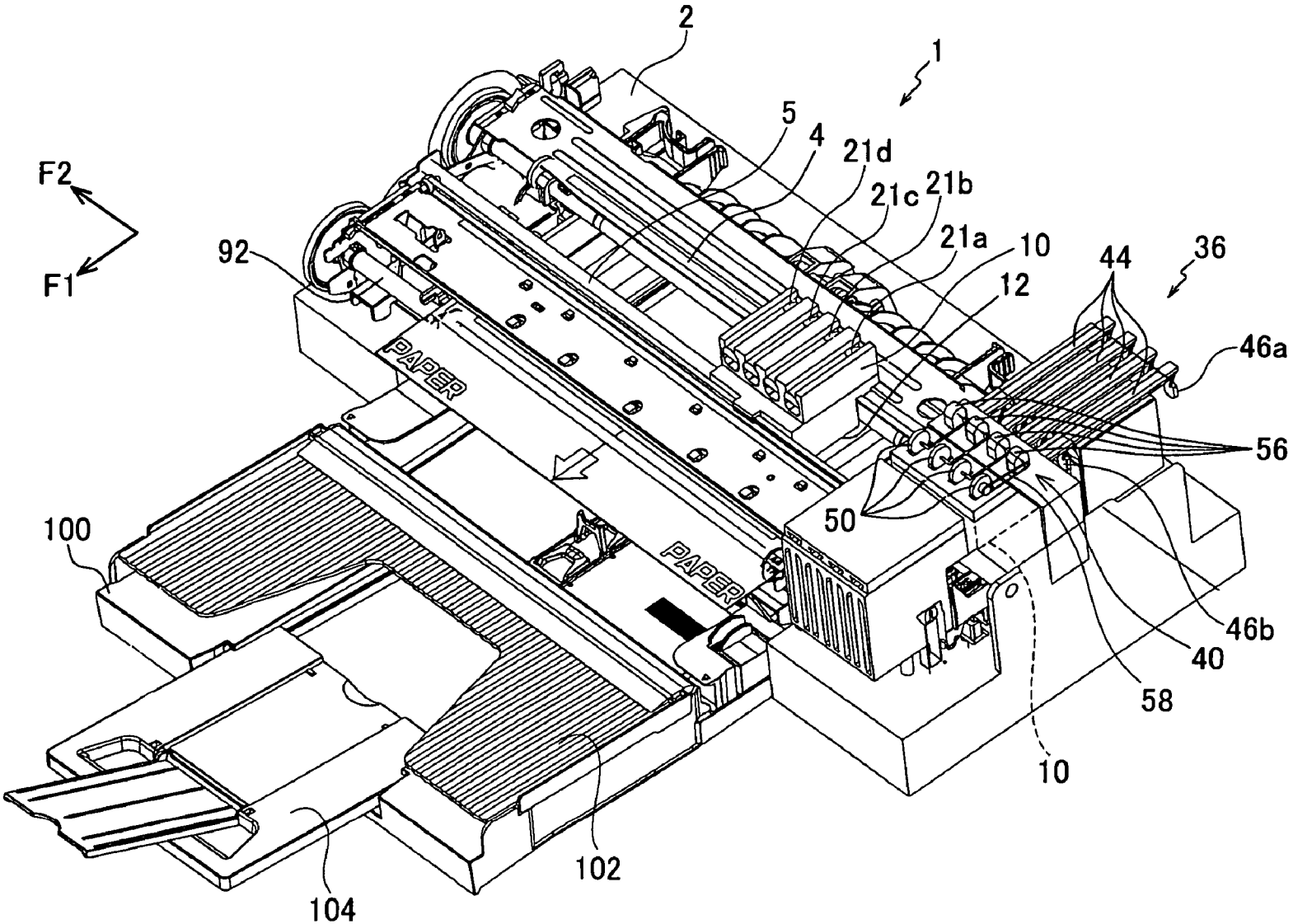
FIG. 1 shows a perspective view of an ink jet printer of a first embodiment.

FIG. 1 shows a perspective view of an ink jet printer 1 of the first embodiment. Further, the direction of the arrow F1 in FIG. 1 is an anterior side of the printer 1.

The ink jet printer 1 has a casing 2. In FIG. 1, a cover of the casing 2 has been omitted so that each of the devices within the casing 2 can be shown. In FIG. 1, a base of the casing 2 is shown. A guide rail 4 is provided within the casing 2. The guide rail 4 extends in a direction (the direction of the arrow F2) perpendicular to the feeding direction (the direction of the arrow F1) of printing paper 6 (shown in FIG. 2). A guide shaft 5 extends at an anterior side of the guide rail 4. The guide shaft 5 is parallel with the guide rail 4. The guide rail 4 and the guide shaft 5 support a carriage 10.

The carriage 10 is engaged with the guide rail 4 and the guide shaft 5 in a manner allowing sliding. The carriage 10 can be moved along the guide rail 4 and the guide shaft 5. The carriage 10 is connected with a carriage motor 244 (not shown in FIG. 1, but shown in FIG. 10). A belt mechanism (not shown) is provided between the carriage 10 and the carriage motor 244. When the carriage motor 244 is driven, driving force is applied to the carriage 10 via the belt mechanism. The carnage 10 therefore moves along the guide rail 4. In FIG. 1, the carriage 10 is shown by a broken line in a position furthest to the right (at the side furthest from the direction of the arrow F2). When the carriage 10 is in this position, an action (to be described) for exchanging an ink cartridge is performed.

Four ink cartridges 21*a*, 21*b*, 21*c*, and 21*d* are supported by the carriage 10. Each of the ink cartridges 21*a* to 21*d* can be attached to or removed from the carriage 10. The ink cartridge 21*a* stores black ink. The ink cartridge 21*b* stores cyan ink. The ink cartridge 21*c* stores yellow ink. The ink cartridge 21*d* stores magenta ink.

Figure 8:
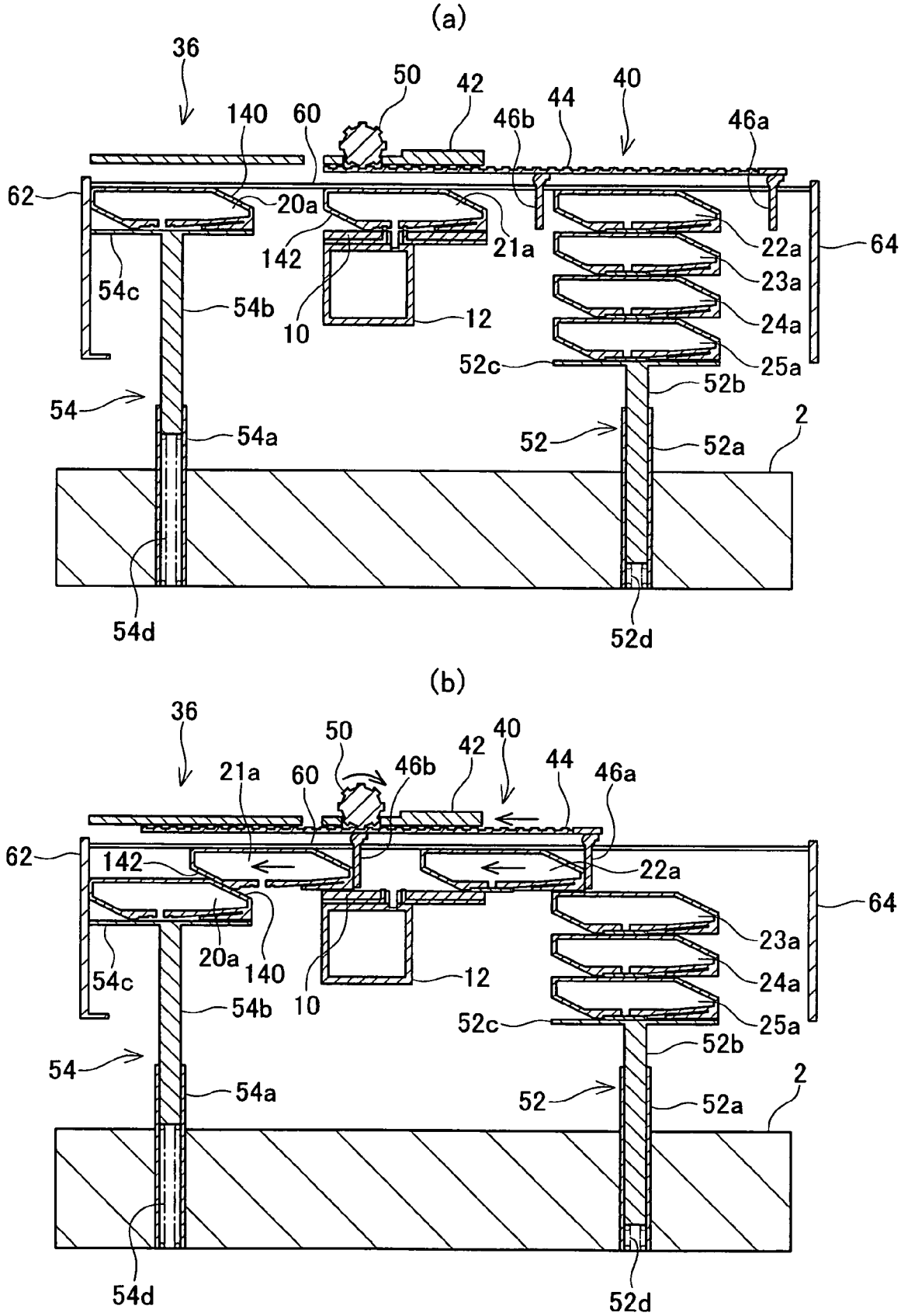
FIG. 8(*a*) shows a state immediately prior to the ink cartridge being exchanged.
Figure 9:
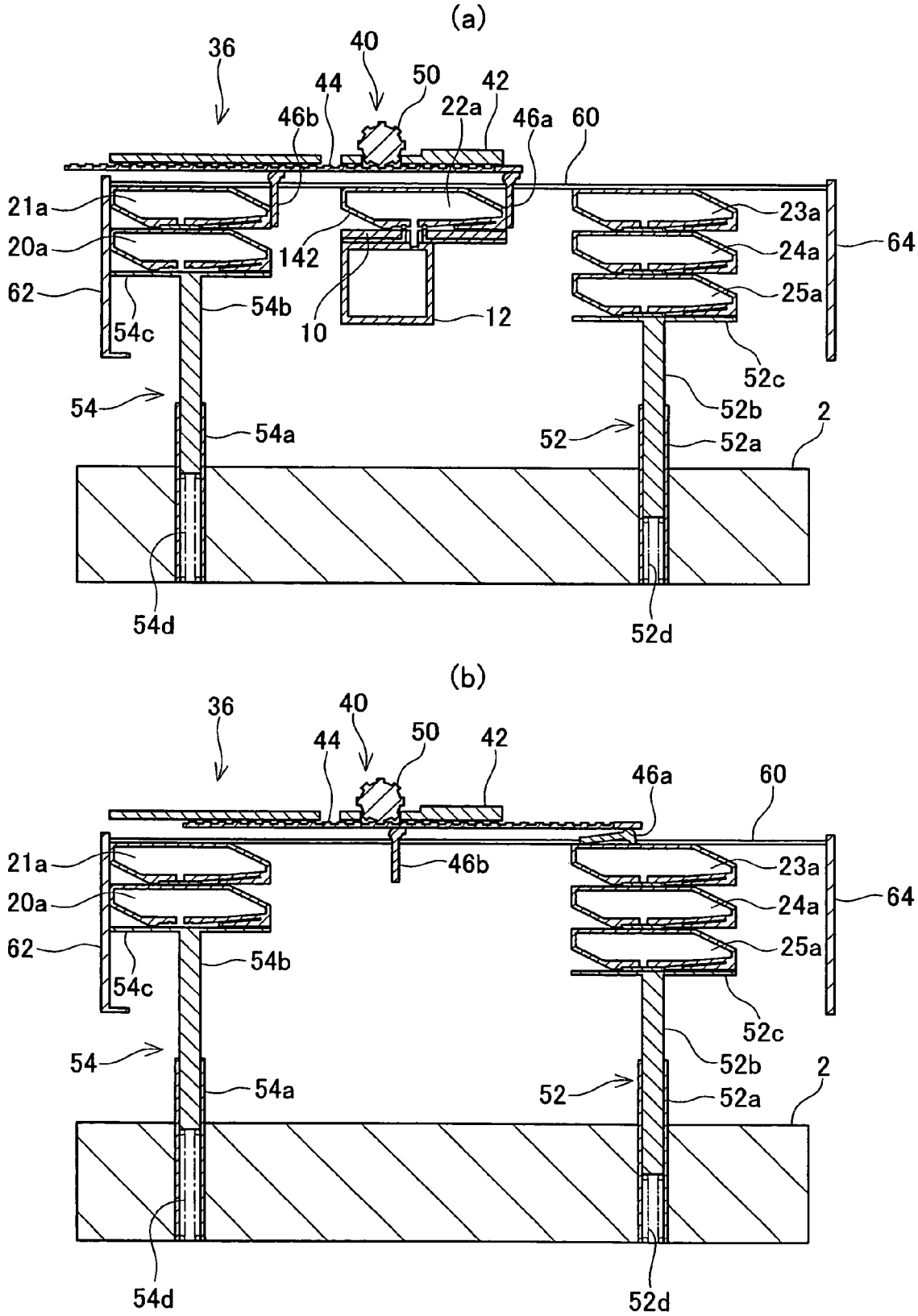
FIG. 9(*a*) shows a state immediately after the ink cartridge has been exchanged.

The printer 1 of the present embodiment is provided with black ink cartridges 20*a*, 22*a*, 23*a*, 24*a*, and 25*a* (these are not shown in FIG. 1, but are shown in FIG. 8 and FIG. 9) in addition to the ink cartridge 21*a*. That is, there are six ink cartridges for storing black ink. The ink cartridges 20*a*, 22*a*, 23*a*, 24*a*, and 25*a*, which are not currently being supported by the carriage 10, are disposed in an ink cartridge exchanging device 36 (to be described). The manner in which the ink cartridges 20*a* to 25*a* are used will be described in detail later. Similarly, the printer 1 has six ink cartridges 20*b* to 25*b* that store cyan ink, six ink cartridges 20*c* to 25*c* that store yellow ink, and six ink cartridges 20*d* to 25*d* that store magenta ink.

The carriage 10 supports an ink jet head 12. The ink jet head 12 is fixed to a lower face of the carriage 10, and a plurality of nozzles (not shown) are formed in a lower face of the ink jet head 12. The ink jet head 12 draws in ink from the ink cartridges 21*a* to 21*d*, and discharges this ink from the nozzles. The printer 1 of the present embodiment discharges ink from the ink jet head 12 onto the printing paper 6 while the cartridge 10 is moving in a left-right direction. That is, the printer 1 of the present embodiment is a serial type printer.

Figure 2:
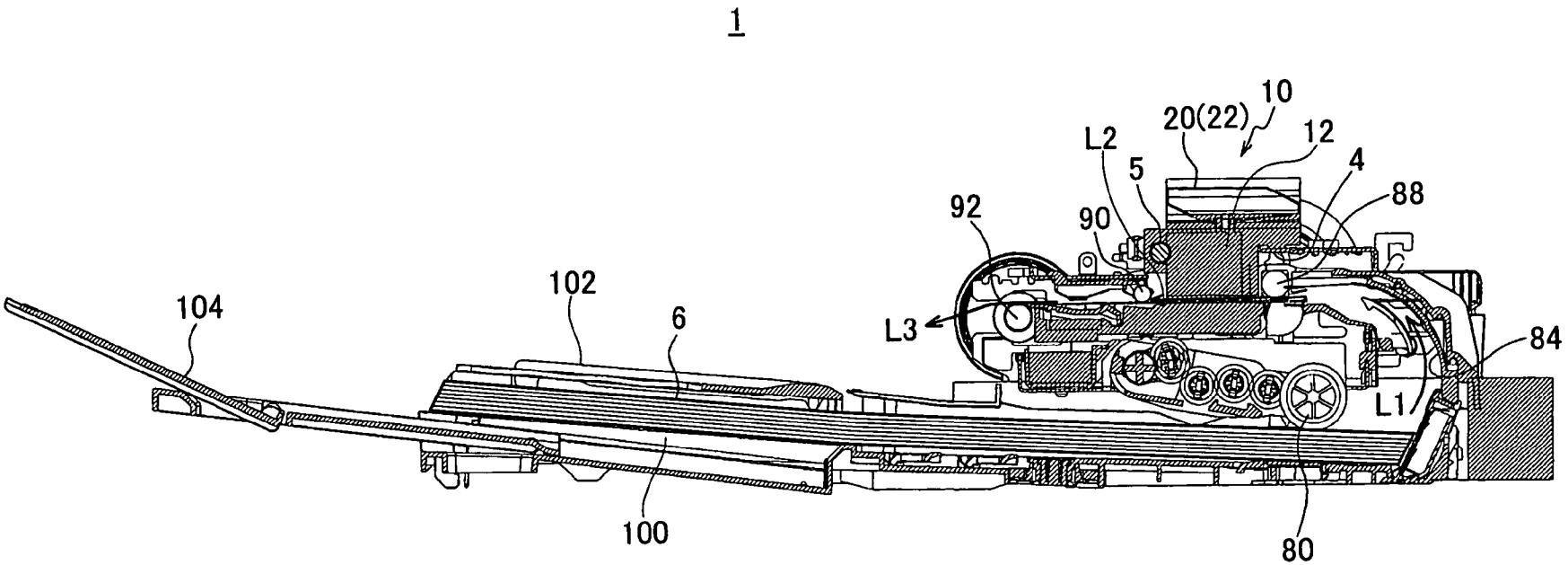
FIG. 2 shows a longitudinal sectional view of the ink jet printer.

A paper feed tray 100 is disposed at the anterior of the base of the casing 2. The paper feed tray 100 is disposed at the exterior of the casing 2. A paper discharge tray 102 is disposed above the paper feed tray 100, this paper discharge tray 102 receiving the printing paper 6 that has been printed and discharged. A plurality of sheets of printing paper 6 are stacked between the paper feed tray 100 and the paper discharge tray 102 (this is shown in FIG. 2). A reserve tray 104 is disposed at the anterior of the paper feed tray 100, this reserve tray 104 receiving printing paper 6 so large that it projects from the paper discharge tray 102.

The ink cartridge exchanging device 36 is provided. Below, the ink cartridge exchanging device 36 will be termed simply 'exchanging device 36'. The exchanging device 36 is provided with a transferring device 40. etc.

The transferring device 40 transfers the ink cartridges 20*a*, etc., thus removing the ink cartridges 20*a*, etc. from the carriage 10, and attaching the ink cartridges 20*a*, etc. thereto.

The configuration of the exchanging device 36 will be described in detail below.

Next, the method by which the printing paper 6 is transferred will be described with reference to FIG. 2. FIG. 2 shows a longitudinal sectional view of the printer 1. As shown in FIG. 2, a plurality of sheets of printing paper 6 is stacked on the paper feed tray 100. A feeding roller 80 makes contact with an uppermost sheet of the printing paper 6. When the feeding roller 80 rotates in a counterclockwise direction the printing paper 6 is transferred along a rail 84 (in the direction of the arrow L1). The printing paper 6 that has been moved in the direction of the arrow L1 makes contact with a lower edge of a resist roller 88. The resist roller 88 rotates in a clockwise direction. Then the printing paper 6 is transported (see arrow L2) to a position facing the lower face (i.e. the nozzle face) of the ink jet head 12. In this state, ink is discharged from the ink jet head 12 onto the printing paper 6, and the printing paper 6 is thus printed. The ink is discharged from the ink jet head 12 while the carriage 10 is moving along the guide rail 4 and the guide shaft 5. Printing can thus be performed across the entire widthwise range of the printing paper 6 (the direction perpendicular to the plane of the page of FIG. 2). The printing paper 6 that has been printed makes contact with a pinch roller 90. The pinch roller 90 does not make contact with a driving source, but is instead driven by its contact with the printing paper 6. The printing paper 6 is transferred (see arrow L3) by a discharge roller 92 to the paper discharge tray 102.

Figure 10:
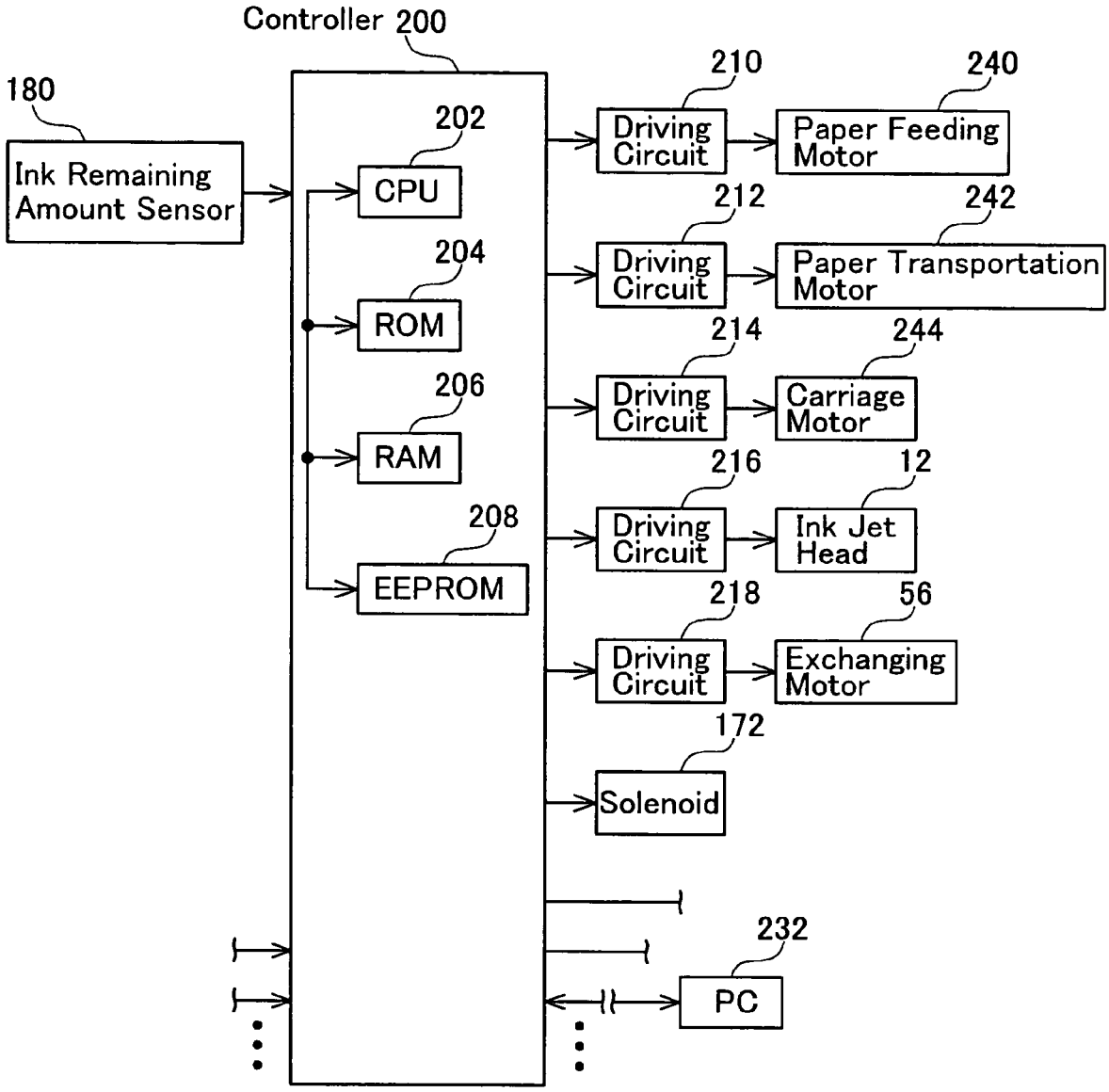
FIG. 10 shows a control configuration of the ink jet printer.

The feeding roller 80 is driven by a paper feeding motor 240 (see FIG. 10). The remaining rollers (the resist roller 88 and the discharge roller 92) are driven by a paper transportation motor 242 (see FIG. 10).

Figure 4:
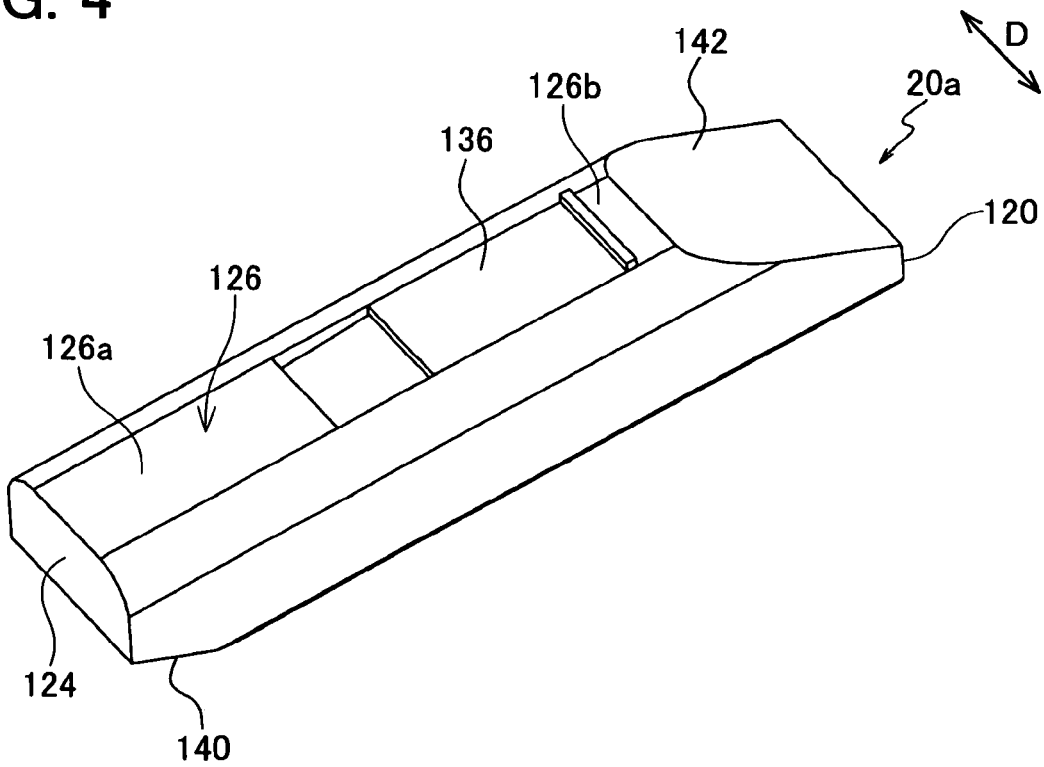
FIG. 4 shows a perspective view of the ink cartridge viewed obliquely from below.
Figure 5:
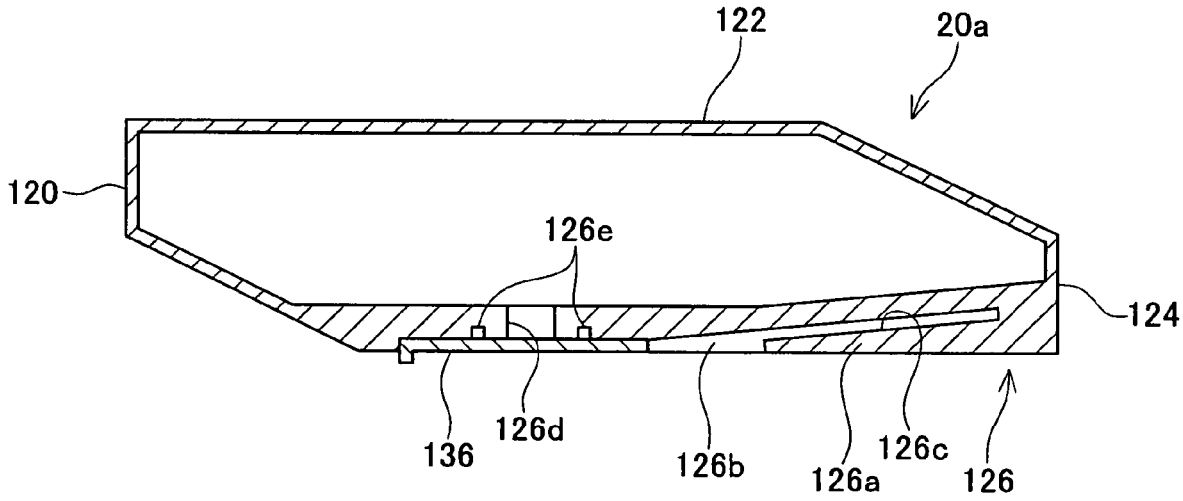
FIG. 5 shows a longitudinal sectional view of the ink cartridge.

Next, the configuration of the ink cartridges 20*a*, etc. will be described in detail with reference to FIGS. 3 to 5. Each of the ink cartridges 20*a*, etc. has identical configuration. Here, the configuration of the ink cartridge 20*a* will be described.

Figure 3:
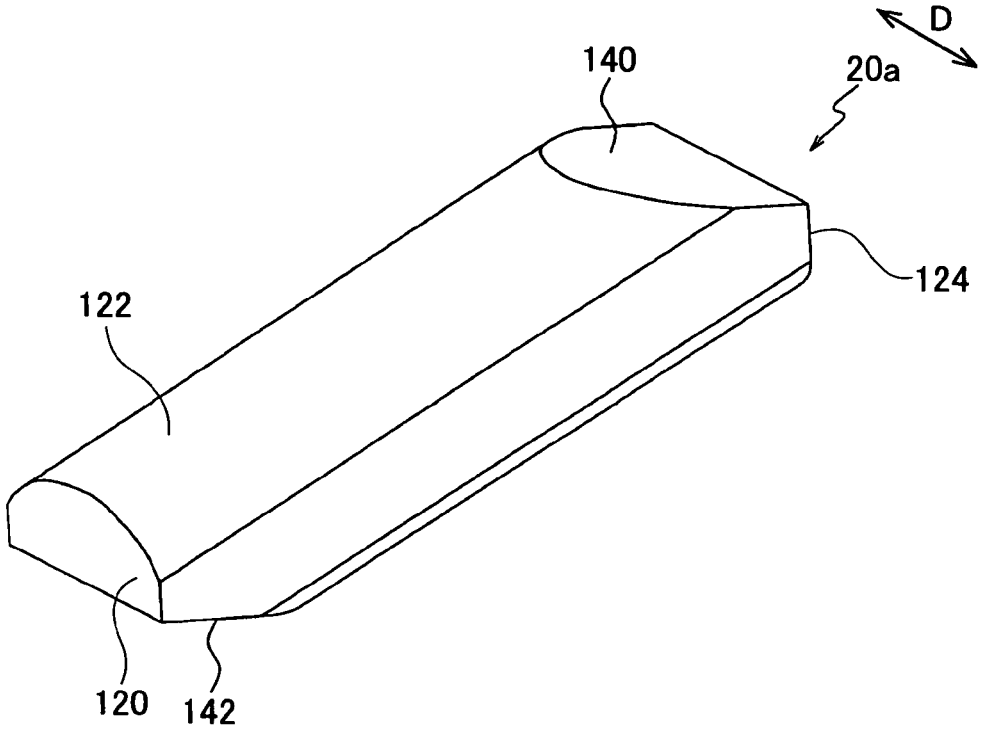
FIG. 3 shows a perspective view of an ink cartridge viewed obliquely from above.

FIG. 3 shows a perspective view of the ink cartridge 20*a* viewed obliquely from above. FIG. 4 shows a perspective view of the ink cartridge 20*a* viewed obliquely from below. FIG. 5 shows a longitudinal sectional view of the ink cartridge 20*a*.

The ink cartridge 20*a* is substantially box shaped. An anterior face 120 of the ink cartridge 20*a* is flat. The anterior face 120 forms a face at the anterior side when the ink cartridge 20*a* has been moved from the carriage 10 to a second support device 54 (see FIG. 8, etc.), and when the ink cartridge 20*a* has been moved to the carriage 10 from a first support device 52 (to be described. See FIG. 8, etc.).

A central part, relative to the left-right direction (the direction of the arrow D in FIG. 3 and FIG. 4), of an upper face 122 of the ink cartridge 20*a* rises upwards.

A base face 126 of the ink cartridge 20*a* has a flat part 126*a* and a groove 126*b*. A shutter 136 fits, in a manner allowing sliding, into the groove 126*b*. The groove 126*b* grows deeper towards a posterior face 124. This shape is shown clearly in FIG. 5. The deeper portion of the groove 126*b* is covered by the part 126*a*, thus forming a space 126*c* between the part 126*a* and a base face of the groove 126*b*. The space 126*c* is greater than the shutter 136. When the shutter 136 moves towards the right from the state shown in FIG. 5, the shutter 136 is housed within the space 126*c*. A through hole 126*d* is formed in the base face of the groove 126*b*. The shutter 136 opens and closes this through hole 126*d*. The through hole 126*d* is open when the shutter 136 is housed within the space 126*c*. In this state, the ink jet head 12 can use the ink of the ink cartridge 20*a*. Further, the ink cartridge 20*a* is provided with a spring member (not shown) for energizing the shutter 136 in the closed direction. The shutter 136 is closed as long as there is no force applied thereto that opposes the spring force. Moreover, a small groove 126*c* is formed in the base face of the groove 126*b*.

As shown in FIG. 3, an inclined plane 140 is formed between the upper face 122 and the posterior face 124. Further, an inclined plane 142 is formed between the anterior face 120 and the base face 126. The inclined planes 140 and 142 help the ink cartridge 20*a* move smoothly.

Figure 6:
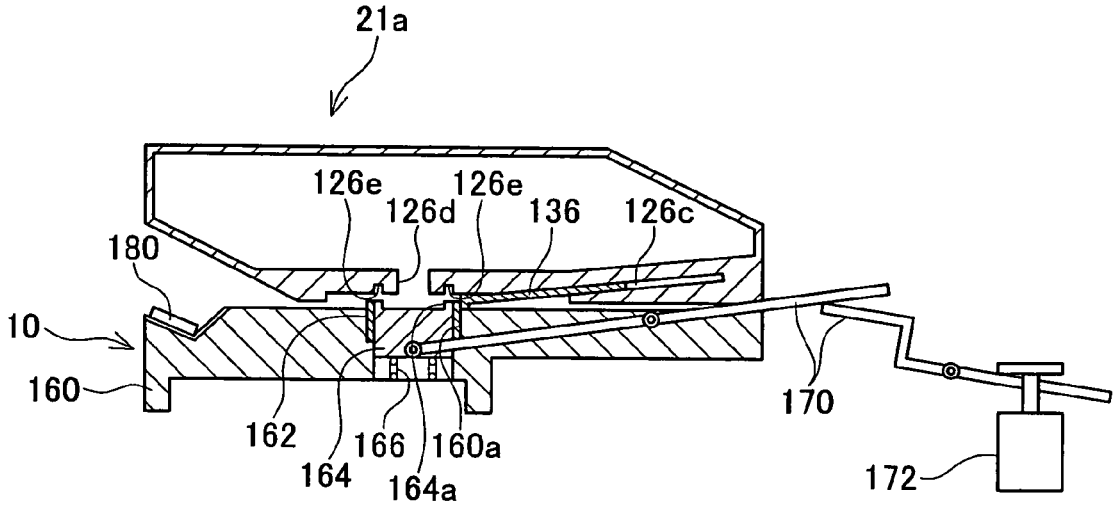
FIG. 6 shows a state before the ink cartridge has been connected with a carriage.
Figure 7:
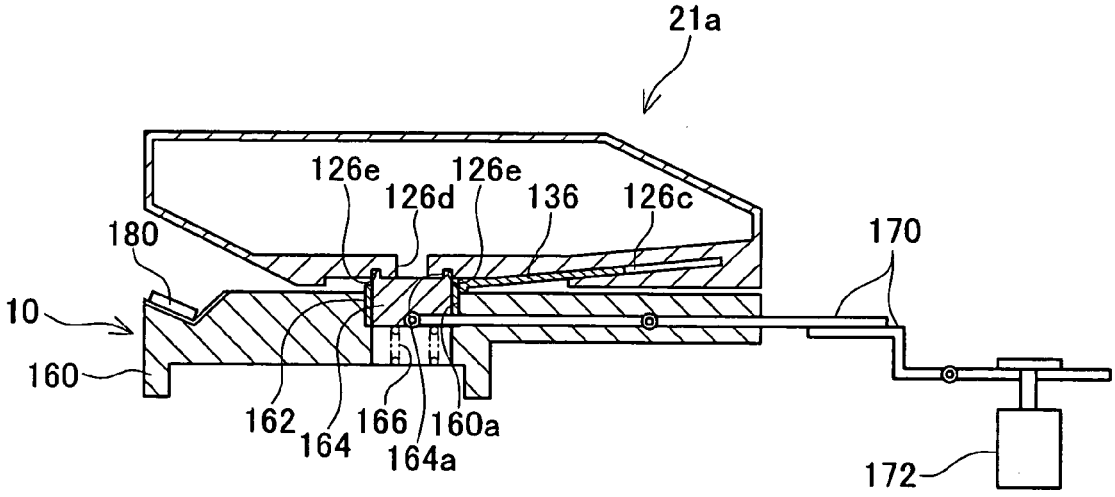
FIG. 7 shows a state after the ink cartridge has been connected with the carriage.

The ink cartridges 20*a*, etc. are attached to the carriage 10. This state is described with reference to FIG. 6 and FIG. 7. FIG. 6 shows a state immediately prior to the ink cartridge 21*a* being mounted on the carriage 10. FIG. 7 shows a state after the ink cartridge 21*a* has been mounted on the carriage 10. In FIGS. 6 and 7, the ink jet head 12 fixed to the lower face of the carriage 10 is not shown.

First, the configuration of an upper part (i.e. a part that makes contact with the ink cartridge 21*a*) of the carriage 10 will be described. The carriage 10 has a carriage case 160. A hole 160*a* is formed in a central part of the carriage case 160. A member 162 is fixed to an inner peripheral face of the hole 160*a*, this member 162 protruding upwards beyond an upper face of the carriage case 160. A connecting member 164 fits, in a manner allowing sliding in an up-down direction, with an inner peripheral face of the member 162. An edge 164*a* of an upper face of the connecting member 164 protrudes upwards. A member 166 is disposed below the connecting member 164. The member 166 energizes the connecting member 164 upwards. The connecting member 164 is connected with a link structure 170 that is connected with a solenoid 172. The reference number 180 in the figure refers to a sensor for detecting the remaining amount of ink (an ink remaining-amount sensor). The ink remaining-amount sensor 180 has a radiation unit and a photoreceptor (not shown). The radiation unit radiates light toward the ink cartridge 20*a*. The light can pass through the inclined plane 142 (see FIG. 3) of the ink cartridge 20*a*. In the case where the ink cartridge 20*a* is filled with ink, the light that passed through the inclined plane 142 is reflected by the ink. The photoreceptor can receive the reflected light. The ink remaining-amount sensor 180 detects whether the photoreceptor receives the reflected light when the radiation unit radiates the light. In the case where the photoreceptor receives the reflected light, the ink cartridge 20*a* is filled with ink. In the case where the photoreceptor doesn't receive the reflected light, the amount of remaining ink is very small. The ink remaining-amount sensor 180 outputs a signal when the photoreceptor doesn't receive the reflected light. The signal that has been output is received by a controller 200 (shown in FIG. 10. To be described).

In the state shown in FIG. 6, the solenoid 172 is ON. In this state, the link structure 170 pushes the connecting member 164 downwards. The connecting member 164 is maintained in a downwards position opposing the energizing force of the energizing member 166. In the state shown in FIG. 7, the solenoid 172 is OFF. In this state, the link structure 170 does not apply force to the connecting member 164. The connecting member 164 is lifted to an upwards position by the energizing force of the energizing member 166. The ink cartridge 21*a* is fixed in a manner such that a guide 60 (shown in FIGS. 8 and 9) prevents its movement upwards or downwards. As a result, the ink cartridge 21*a* does not move upwards even when the connecting member 164 is lifted upwards.

Before the ink cartridge 21*a* is attached to the carriage 10, the ink cartridge 21*a* is supported by the fist support device 52 (see FIG. 8, etc.). The shutter 136 is closed when the ink cartridge 21*a* is being supported by the first support device 52. The ink cartridge 21*a* is delivered from the first support device 52 towards the carriage 10. That is, the ink cartridge 21*a* moves towards the left. At this juncture, the shutter 136, which is closed, makes contact with an upper edge of the member 162 of the carriage 10. When the ink cartridge 21*a* moves further towards the left, the member 162 pushes the shutter 136 towards the right, thus opening the shutter 136. The state in which the member 162 is making contact with the shutter 136 is shown clearly in FIG. 6.

In the state shown in FIG. 6, the shutter 136 is open. In this state, the ink of the ink cartridge 21*a* spills from the through hole 126*d*. As a result, when the state shown in FIG. 6 is reached, the solenoid 172 is immediately switched from ON to OFF. Thereupon, the connecting member 164 moves upwards, and an upper end 164*a* of the connecting member 164 fits with the groove 126*e* of the ink cartridge 21*a*. This state is shown in FIG. 7. The ink cartridge 21*a* is thus connected with the carriage 10. When the ink cartridge 21*a* is in a connected state with the carriage 10, the ink jet head 12 can use the ink from the ink cartridge 21*a*. That is, the ink cartridge 21*a* reaches a connected state with the ink jet head 12. In the present embodiment, the ink cartridge 21*a* is connected indirectly with the ink jet head 12 via the carriage 10.

Next, the configuration of the exchanging device 36 will be described. The exchanging device 36 is provided with the transferring device 40, etc. The configuration of the transferring device 40 will be described with reference to FIG. 8(*a*). FIG. 8(*a*) shows the entire configuration of the transferring device 40. FIG. 8(*b*) is a figure showing the ink cartridges 21*a* and 22*a* after they have been transferred from the state in FIG. 8(*a*). The state shown in FIG. 8(*b*) will be described later. Here, mechanisms for transferring the ink cartridges 20*a* to 25*a* are described. The transferring device 40 has four of these mechanisms. These mechanisms are for transferring the ink cartridges 20*a*, etc. for each color of ink.

The transferring device 40 has a guide 42, a rack member 44, contacting members 46*a* and 46*b*, a pinion shaft 50, the guide 60, an anterior cover 62, a posterior cover 64, etc. The guide 42 supports the rack member 44 in a manner allowing sliding. The rack member 44 extends in a left-right direction. Teeth are formed on an upper face of the rack member 44, these teeth engaging with the pinion shaft 50 (to be described). The two contacting members 46*a* and 46*b* are connected perpendicularly with the rack member 44. The contacting member 46*a* is connected with the rack member 44 in a manner allowing swinging. The manner in which this swinging occurs will be described later. The contacting member 46*b* is fixed to the rack member 44. The pinion shaft 50 is supported by the guide 42 in a manner allowing its rotation. The pinion shaft 50 is connected with an exchanging motor 56 (see FIG. 1) via a pulley 58. The guide 60 is disposed below the rack member 44, and a left edge of the guide 60 is connected with the anterior cover 62. A right edge of the guide 60 is connected with the posterior cover 64. The guide 60 is supported by the anterior cover 62 and the posterior cover 64. A lower face of the guide 60 makes contact with an upper face of the uppermost ink cartridge 20*a* that is being supported by the second support device 54 (to be described). The lower face of the guide 60 also makes contact with an upper face of the ink cartridge 21*a* mounted on the carriage 10, and with an upper face of the uppermost ink cartridge 22*a* that is being supported by the first support device 54 (to be described). The anterior cover 62 is fixed to the casing 2 (see FIG. 1). The posterior cover 64 is fixed to the casing 2.

The exchanging device 36 is provided with the first support device 52 and the second support device 54. The first support device 52 is disposed in a position that does not interfere with the carriage 10. When the printer 1 is viewed from a plan view (that is, from a plane perpendicular to the direction of ink discharge), the first support device 52 is offset from the carriage 10 and the ink jet head 12. The first support device 52 has a case 52*a*, a pillar 52*b*, a table 52*c*, and a spring 52*d*. The case 52*a* is a cylindrical shaped member that fits into the base of the casing 2. The pillar 52*b* fits with the case 52*a* in a manner allowing sliding. The table 52*c* is fixed to an upper end of the pillar 52*b*. The spring 52*d* is housed within the case 52*a*. The spring 52*d* energizes the pillar 52*b* upwards. The first support device 52 supports the spare ink cartridges (22*a* to 25*a* in FIG. 8(*a*)) that are used when the ink has run out in the ink cartridge currently mounted on the carriage 10 (the ink cartridge 21 a in FIG. 8(*a*)). The first support device 52 supports the plurality of spare ink cartridges 22*a* to 25*a* in a stacked state.

The second support device 54 is disposed to the left of the first support device 52. The second support device 54 is disposed in a position that does not interfere with the carriage 10. When the printer 1 is viewed from a plan view (that is, from a plane perpendicular to the direction of ink discharge), the second support device 54 is offset from the carriage 10 and the ink jet head 12. The second support device 54 has an identical configuration with that of the first support device 52. That is, the second support device 54 has a case 54*a*, a pillar 54*b*, a table 54*c*, and a spring 54*d*. The second support device 54 supports the used ink cartridges (20*a* in FIG. 8(*a*)).

The carriage 10 can be moved in a direction perpendicular to the face of the page in FIG. 8(*a*) within the range between the first support device 52 and the second support device 54. When the carriage 10 is in the position shown by the broken line in FIG. 1, the carriage 10 is in the position of FIG. 8(*a*).

The manner in which the transferring device 40 transfers the ink cartridges 20*a* to 25*a* will be described in detail below.

Next, the configuration for controlling the printer 1 will be described. FIG. 10 is a block figure showing a control configuration of the printer 1. The controller 200 controls the operation of the printer 1. The controller 200 is a microcomputer that has a CPU 202, a ROM 204, a EM 206, and an EEPROM 208. The CPU 202 controls each of the devices 210, etc. on the basis of control programs stored in the ROM 204. The RAM 206 temporarily stores data used while the CPU 202 is executing processes. The EEPROM 208 is a memory that stores programs, data, etc.

The ink remaining-amount sensor 180 is connected with the controller 200. The ink remaining-amount sensor 180 outputs a signal when the amount of ink remaining in the ink cartridge 20*a* etc. currently mounted on the carriage 10 is reduced to below a predetermined amount. The controller 200 can detect, from the signal that has been input, that the amount of ink is low in the ink cartridge 20*a*, etc. Only one ink remaining-amount sensor 180 is shown in FIG. 10. However, there are actually four ink remaining-amount sensors 180 mounted on the carriage 10. The controller 200 can detect the amount of remaining ink in each of the four ink cartridges 20*a*, etc. supported by the carriage 10.

The controller 200 is connected with driving circuits 210 to 218. The controller 200 outputs control signals to the driving circuits 210 to 218. The driving circuit 210 drives the paper feeding motor 240 based on the signals output from the controller 200. The feeding roller 80 (see FIG. 2) thus rotates. The driving circuit 212 drives the paper transportation motor 242 based on the signals output from the controller 200. The resist roller 88 and the discharge roller 92 (see FIG. 2) thus rotate. The driving circuit 214 drives the carriage motor 244 based on the signals output from the controller 200. The carriage 10 thus moves along the guide rail 4 and the guide shaft 5 (see FIGS. 1 and 2). The driving circuit 216 drives the ink jet head 12 based on the signals output from the controller 200. Ink is thus discharged from the ink jet head 12. The driving circuit 218 drives the exchanging motor 56 based on the signals output from the controller 200. When the exchanging motor 56 is driven, the rack member 44 (see FIG. 9, etc.) moves along the guide 42.

The controller 200 controls the solenoid 172, thus moving the connecting member 164 (see FIG. 6, etc.) upwards or downwards.

The controller 200 is connected with a PC 232. Printing data output from the PC 232 is input to the controller 200. The printing operation is then executed on the basis of the printing data that has been input. Specifically, the printing data that has been output from the PC 232 is stored temporarily in the RAM 206 by the CPU 202. The CPU 202 produces control signals for driving the devices 240, 242, 244, 12, etc. in accordance with the control program stored in the ROM 204.

An ink cartridge exchanging action executed by the controller 200 will be described in detail immediately below.

The manner for exchanging the ink cartridge 21*a* mounted in the carriage 10 will be described with reference to FIGS. 8 and 9.

With the printer 1 of the present embodiment, six ink cartridges 20*a* to 25*a*, etc. are used for each color of ink. The exchanging action for exchanging the ink cartridges 20*a* to 25*a* is executed by the controller 200. Below, the manner is described for exchanging the ink cartridges 20*a* to 25*a* for black ink. The same action is executed for the other colors of ink.

In FIG. 8(*a*), the ink cartridge 20*a* is being supported by the second support device 54. The ink cartridge 20*a* is an ink cartridge where the ink has already been used up. The ink cartridge 21*a* is mounted on the carriage 10. The ink cartridge 21*a* is an ink cartridge that is being used for printing. The ink cartridges 22*a*, 23*a*, 24*a*, and 25*a* are being supported by the first support device 52. The ink cartridges 22*a* to 25*a* are spare ink cartridges that are to be used.

When the signal output from the ink remaining-amount sensor 180 is input to the controller 200, the carriage 10 is moved to a position between the first support device 52 and the second support device 54. That is, the carriage 10 is moved to the position shown in FIG. 8(*a*) (the position shown by the broken line in FIG. 1). In the state shown in FIG. 8(*a*), the spare ink cartridges 22*a* to 25*a* are supported by the first support device 52. These spare ink cartridges 22*a* to 25*a* are filled with an adequate amount of ink.

When the state shown in FIG. 8(*a*) is reached, the controller 200 switches the solenoid 172 (see FIG. 6, etc.) from OFF to ON. The state thus changes from the state shown in FIG. 7 to the state shown in FIG. 6. The connecting member 164 is released from its engagement with the groove 126*e* of the ink cartridge 21*a*.

Next, the controller 200 causes the pinion shaft 50 to rotate in a clockwise direction. The rack member 44 thus moves towards the left. When the rack member 44 moves towards the left, the contacting member 46*b* makes contact with the ink cartridge 21*a* mounted on the carriage 10. Simultaneously, the contacting member 46*a* makes contact with the uppermost ink cartridge 22*a* that is being supported by the first support device 52. When the rack member 44 moves further towards the left, the contacting member 46*b* pushes the ink cartridge 21*a* towards the left. The ink cartridge 21*a* is thus removed from the carriage 10. The ink cartridge 21*a* is pushed by the contacting member 46*b* and thus makes contact with the ink cartridge 20*a*. That is, the state shown in FIG. 8(*b*) is reached. In FIG. 8, etc. there appears to be a large space between the second support device 54 and the carriage 10. However, the actual space is not that large. As a result, the space does not impede the transfer of the ink cartridge 21*a*.

The inclined plane 142 is formed in the ink cartridge 21*a*. The inclined plane 140 is formed in the ink cartridge 20*a*. When the ink cartridge 21*a* is transferred towards the left, the inclined planes 142 and 140 make contact, as shown in FIG.

8(*b*). The guide 60 prevents the ink cartridge 21*a* from moving upwards. As a result, when the ink cartridge 21*a* is moved further towards the left, the ink cartridge 20*a* is pushed downwards. The pillar 54*b* and the table 54*c* move downwards in opposition to the energizing force of the spring 54*d*.

While the ink cartridge 21*a* is being transferred to the second support device 54, the ink cartridge 22*a* is also pushed towards the left by the contacting member 46*a* The ink cartridge 22*a* is thus transferred from the first support device 52 to the carriage 10. There appears to be a large space between the first support device 52 and the carriage 10. However, the actual space is not that large. As a result, the space does not impede the transfer of the ink cartridge 22*a*.

The ink ridge 22*a* is transferred to the carriage 10 while the ink cartridge 21*a* is being transferred to the second support device 54. The state shown in FIG. 9(*a*) is thus reached. When this state is reached, the controller 200 switches the solenoid 172 (see FIG. 6, etc.) from ON to OFF. The state thus changes from the state shown in FIG. 6 to the state shown in FIG. 7. The connecting member 164 is engaged with the ink cartridge 22*a*.

When the state shown in FIG. 9(*a*) is reached, the two used ink cartridges 20*a* and 21*a* are supported by the second support device 54. The pillar 54*b* and the table 54*c* are energized upwards by the spring 54*d*. As a result, the ink cartridges 20*a* and 21*a* are maintained stably in a stacked state between the table 54*c* and the guide 60. The first support device 52 is supporting the three spare ink cartridges 23*a* to 25*a*. The energizing force of the spring 52*d* moves the pillar 52*b*, the table 54, and the three spare ink cartridges 23*a* to 25*a* upward when the ink cartridge 22*a* is transferred from the first support device 52 to the carriage 10. The ink cartridge 23*a* makes contact with the guide 60. This state is shown in FIG. 9(*a*).

When the state shown in FIG. 9(*a*) is reached, the ink cartridge 22*a* is mounted on the carriage 10. The ink cartridge 22*a* is filled with ink, and the printing operation can be executed using the ink cartridge 22*a*. The carriage 10 can move between the positions of the first support device 52 and of the second support device 54. When the carriage 10 moves from the state shown in FIG. 9(*a*), it reaches the state shown in FIG. 9(*b*).

FIG. 9(*b*) shows a state after the carriage 10 has been moved out from the position between the first support device 52 and the second support device 54. The controller 200 causes the pinion shaft 50 to rotate in a counterclockwise direction. The rack member 44 moves towards the right when the rack member 44 moves towards the right, the contacting member 46*a* makes contact with the ink cartridge 23*a*. When the rack member 44 moves further towards the right, the contacting member 46*a* swings in a clockwise direction. The swinging fulcrum of the contacting member 46 is located close to the rack member 44. The contacting member 46*a* thus reaches the laid state shown in FIG. 9(*b*). The contacting member 46*a* and the ink cartridge 23*a* no longer make contact, and the rack member 44 can be moved further towards the right. When the rack member 44 has been moved to the state in FIG. 8(*a*), the controller 200 halts the rotation of the pinion shaft 50.

The ink cartridge exchanging action is completed by executing the aforementioned actions consecutively. When the ink runs out in the ink cartridge 22*a* mounted in the carriage 10, the ink cartridge 22*a* is transferred from the carriage 10 to the second support device 54. Simultaneously, the ink cartridge 23*a* is transferred to the carriage 10. The printing operation is executed using the ink cartridge 23*a*. Similarly, when the ink runs out in the ink cartridge 23*a*, the ink cartridge 24*a* is used, and when the ink runs out in the ink cartridge 24*a*, the ink cartridge 25*a* is used. When the ink runs out in the ink cartridge 25*a*, the user exchanges all the ink cartridges 20*a* to 25*a* for new ink cartridges.

With the printer 1 of the present embodiment, six ink cartridges 20*a* to 25*a*, etc. are provided for each color of ink For example, when the ink runs out in the ink cartridge 20*a*, the ink cartridge 20*a* can be replaced by the ink cartridge 21*a*. When the ink runs out in the ink cartridge 21*a*, the ink cartridge 21*a* can be replaced by the ink cartridge 22*a*. The printer 1 can house the six ink cartridges 20*a* to 25*a*, etc. for one color of ink, and consequently the user has to exchange the ink cartridges less frequently.

If a single ink cartridge is increased in size, it can house a large amount of ink. In this case, the user has to exchange the ink cartridges less frequently. However, the ink cartridge becomes heavy if it is increased in size, and the carriage 10 must move this heavy ink cartridge. In this case, it is difficult to stop the carriage 10 accurately in the position desired It is preferred that the ink cartridge supported by the carriage 10 is made as light as possible. In the present embodiment, the ink cartridges 20*a*, etc. are not particularly large. However, the six ink cartridges 20*a* to 25*a*, etc. are used for each color of ink, and consequently a large amount of ink can be stored in the printer 1. The printer 1 of the present embodiment can reduce the weight load on the carriage 10, and also allow the user to exchange the ink cartridges less frequently.

The first support device 52 can support a maximum of five spare ink cartridges. These five spare ink cartridges can be supported in a stacked state. The direction in which the spare ink cartridges are stacked is the direction in which ink is discharged from the ink jet head 12. The printer 1 can house the spare ink cartridges while scarcely being increased in size. Further, the second support device 54 can support a maximum of five used ink cartridges. There is therefore no need for the user to remove the ink cartridges 20*a* to 25*a*, etc. each time one of these ink cartridges 20*a* to 25*a*, etc runs out of ink, and this is extremely convenient. Furthermore, the five used ink cartridges are maintained in a stacked state. The direction in which the used ink cartridges are stacked is the direction in which ink is discharged from the ink jet head 12.

In the present embodiment, the ink jet head 12, the carriage 10, and the ink cartridge that is connected with the ink jet head 12 are all aligned in the direction of ink discharge. The spare ink cartridges 20, etc. and the used ink cartridges can thus be disposed at a space for the height of the devices 10, 12, and 20*a*, etc. The spare ink cartridges and the used ink cartridges can thus be housed using the space already required for the devices 10, 12, and 20*a*, etc. As a result, an increase in the size of the printer 1 can be reduced. The printer 1 of the present embodiment is capable of housing a plurality of spare ink cartridges and a plurality of used ink cartridges.

As shown in FIG. 8(*a*), the uppermost ink cartridge 22*a* currently being supported by the first support device 52 is at the same level as the ink cartridge 21*a* that is mounted on the carriage 10. The spare ink cartridges 23*a* to 25*a* are maintained in a range below the height of the ink cartridge 21*a* that is currently mounted on the carriage 10. Further, the uppermost ink cartridge 20*a* currently being supported by the second support device 54 is at the same level as the ink cartridge 21*a* that is mounted on the carriage 10. The used ink cartridge 20*a* is maintained in a range below the level of the ink cartridge 21*a* that is currently mounted on the carriage 10. Basically, a space below the ink jet head 12 is large because a space for a transportation device for transporting the paper 6 is required. In this embodiment, the spare ink cartridges and the used ink cartridges are maintained in a range below the level of the ink cartridge that is currently mounted on the carriage 10. Therefore, this printer 1 can store spare ink cartridges and the used ink cartridges using the space for the transportation device. As a result, the printer 1 can be prevented from increasing in size in an up-down direction.

In the present embodiment, the ink is discharged downwards from the ink jet head 12. The ink jet head 12 thus does not readily become dirty, and the printing of the ink jet head 12 can be maintained satisfactorily.

Furthermore, the inclined planes 140 and 142 are formed in the ink cartridges. As a result, the ink cartridges can be transferred smoothly. Moreover, the ink cartridges can be stacked on the second support device 54 using the inclined planes 140 and 142.

In the present embodiment, the action of transferring one of the ink cartridges from the carriage 10 to the second support device 54 is executed simultaneously with the action of transferring another of the ink cartridges from the first support device 52 to the carriage 10. The ink cartridges can therefore be exchanged rapidly.

Variants of the aforementioned embodiment will now be given.

(1) In the ink jet printer 1 of the present embodiment, the ink is discharged downwards. However, the ink may equally well be discharged in any desired direction, such as horizontally, upwards etc.

(2) A configuration is equally possible in which the used ink cartridges 20*a*, etc. are discharged to the exterior of the printer 1.

(3) In the present representative embodiment, the ink cartridges 20*a*, etc. are stacked in an up-down direction in the first support device 52 or the second support device 54. However, it is not necessary to stack the ink cartridges 20*a*, etc. in a purely up-down direction. The ink cartridges 20*a*, etc. may be stacked in, for example, an inclined direction.

Second Embodiment

Figure 11:
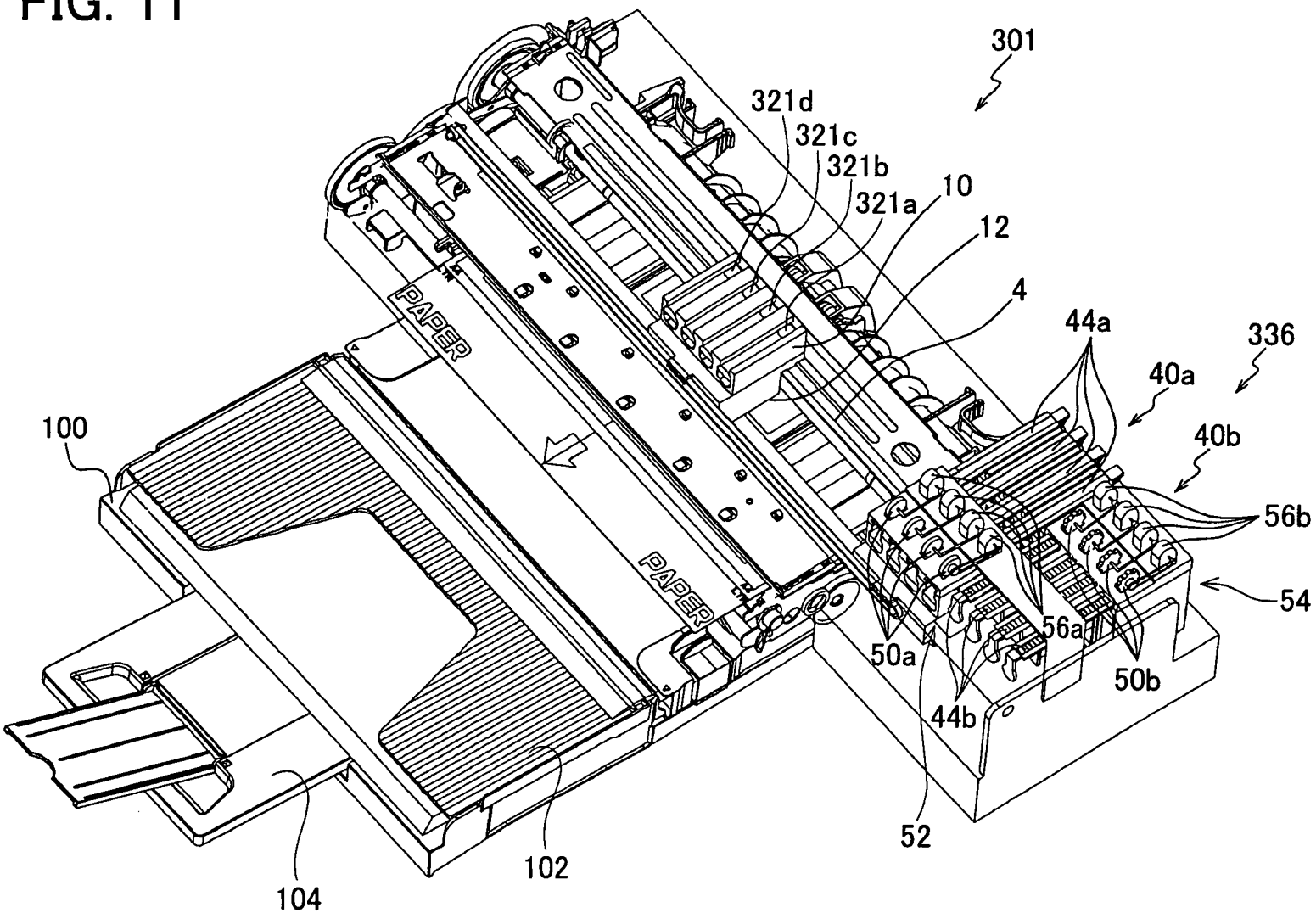
FIG. 11 shows a perspective view of an ink jet printer of a second embodiment.

Next, an ink jet printer 301 of a second embodiment will be described with reference to FIG. 11. The printer 301 differs from the first embodiment in the configuration of an ink cartridge exchanging device 336, and of ink cartridges 321*a*, etc. The points differing from the first embodiment will be described in detail in the present embodiment. FIG. 11 shows a perspective view of the printer 301 of the second embodiment. In the present embodiment, the first support device 52 and the second support device 54 are aligned in the direction of movement of the carriage 10. In the present embodiment, the exchanging device 336 has two transferring devices 40*a* and 40*b*. The transferring device 40*a* is disposed in the vicinity of the first support device 52. The transferring device 40*b* is disposed in the vicinity of the second support device 54.

In the present embodiment, as well, six ink cartridges 321*a*, etc. are provided for each color of ink. The ink cartridges 320*a* to 325*a* are provided for black ink. In FIG. 11, only the ink cartridge 321*a* mounted on the carriage 10 can be seen. Similarly, six ink cartridges are used for each of the other colors. In FIG. 11, the ink cartridges 321*b*, 321*c*, and 321*d* can be seen The manner of exchanging the ink cartridge 321*a* is described below. When, for example, the ink runs out in the ink cartridge 321*a*, the carriage 10 is moved to a position close to the second support device 54. When the carriage 10 has been moved to the position close to the second support device 54, the ink cartridge 321*a* is transferred from the carriage 10 to the second support device 54. This transferring action can be executed using a rack member 44*b* and a pinion shaft 50*b*, in the same manner as in the first embodiment. Like the first embodiment, the second support device 54 has a case 54*a*, a pillar 54*b*, a table 54*c*, and a spring 54*d* (See FIG. 8(*a*), etc.). The second support device 54 can support a plurality of used ink cartridges in a stacked state.

When the ink cartridge 321*a* has been transferred from the carriage 10 to the second support device 54, the carriage 10 is moved to a position close to the first support device 52. A black ink cartridge is not mounted on the carriage 10 during this movement. When the carriage 10 has been moved to the position close to the first support device 52, the uppermost spare ink cartridge 322*a* (shown in FIG. 17), that is being supported by the first support device 52, is transferred to the carriage 10. The ink cartridge 322*a* is thus mounted on the carriage 10, and the printing operation can be executed using the ink cartridge 322*a*. Like the first embodiment, the first support device 52 has a case 52*a*, a pillar 52*b*, a table 52*c*, and a spring 52*d* (see FIG. 8 (a)). The first support device 52 can support a plurality of spare ink cartridges in a stacked state.

Figure 12:
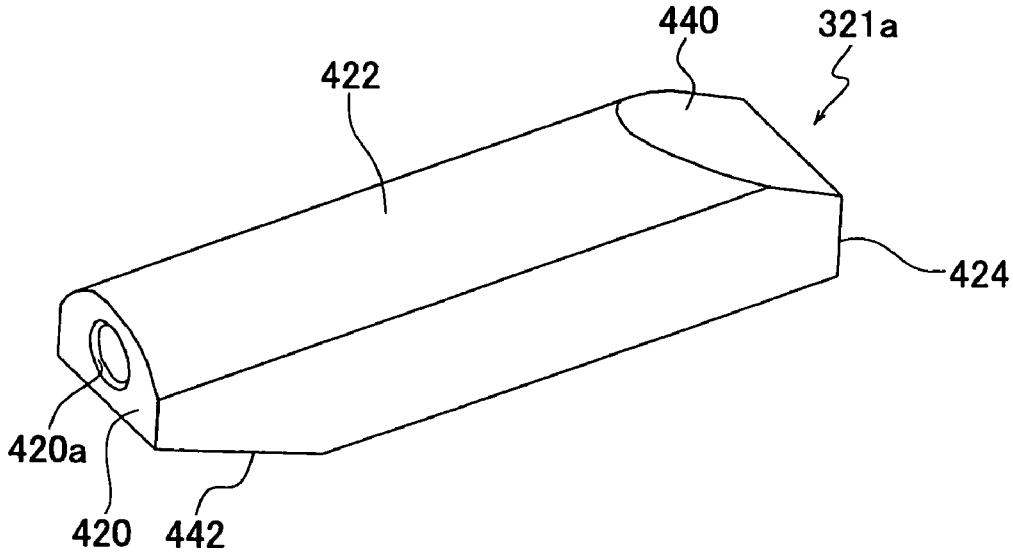
FIG. 12 shows a perspective view of an ink cartridge viewed obliquely from above.
Figure 13:
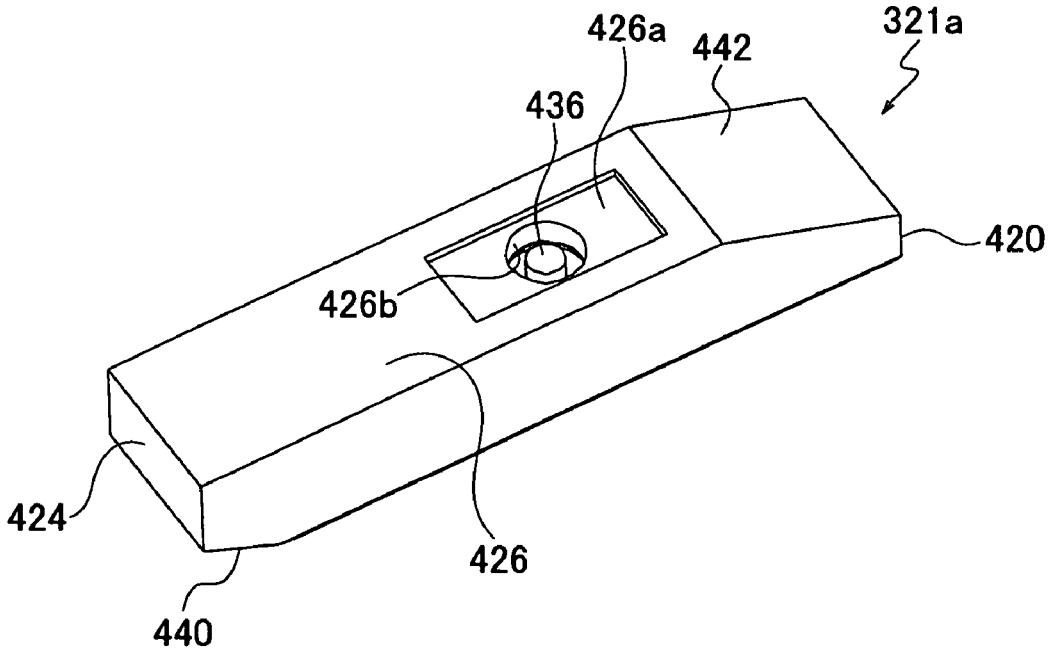
FIG. 13 shows a perspective view of the ink cartridge viewed obliquely from below.
Figure 14:
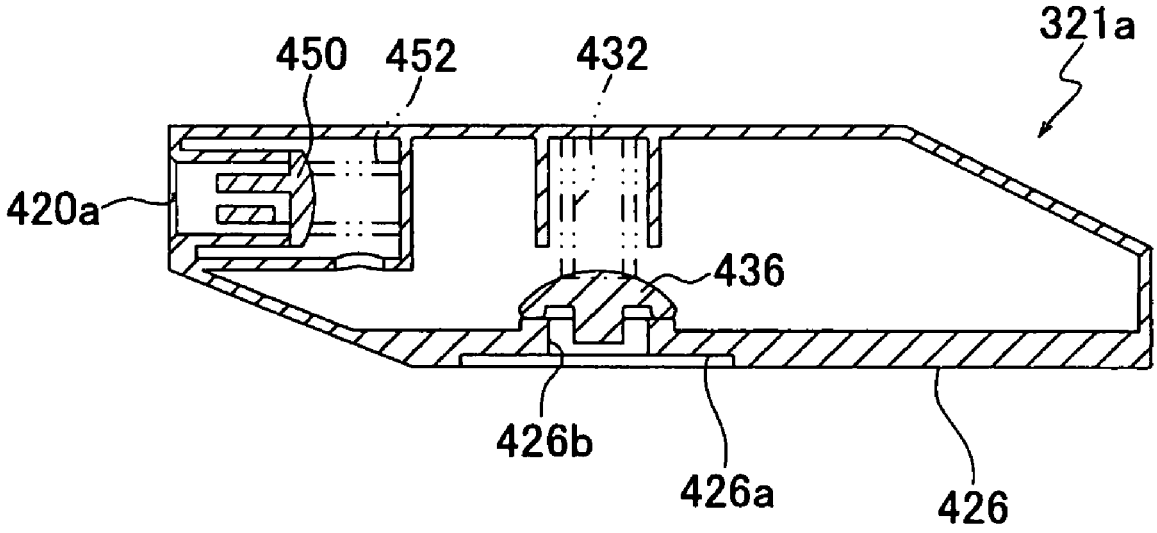
FIG. 14 shows a longitudinal sectional view of the ink cartridge.

Next, the ink cartridge 321*a* of the present embodiment will be described with reference to FIGS. 12 to 14. FIG. 12 shows a perspective view of the ink cartridge 321*a* viewed obliquely from above. FIG. 13 shows a perspective view of the ink ridge 321*a* viewed obliquely from below. FIG. 14 shows a longitudinal sectional view of the ink cartridge 321*a*.

The ink cartridge 321*a* has an inclined plane 440 formed between an upper face 422 and a posterior face 424. Further, an inclined plane 442 is formed between an anterior face 420 and a base face 426.

A groove 426*a* that has a base is formed in the base face 426 of the ink cartridge 321*a*. A hole 426 is formed in a base face of the groove 426*a*. A cap 436 is inserted into the hole 426*b*. As shown in FIG. 14, the cap 436 is energized downwards by an energizing member 432. As long as upwards force is not applied to the cap 436, this cap 436 closes the hole 426*b*.

A replenishing hole 420*a* for replenishing the ink is formed in the anterior face 420 of the ink cartridge 321*a*. As is clear from FIG. 14, a cap 450 is formed within the replenishing hole 420*a* The cap 450 is energized towards the replenishing hole 420*a* by an energizing member 452. The cap 450 closes the replenishing hole 420*a* as long as force from the exterior of the replenishing hole 420*a* is not applied to the cap 450. When force from the exterior is applied to the cap 450, the cap 450 is opened. In this state, the user can replenish the ink in the ink cartridge 321*a*. The used ink cartridges can therefore be reused.

Figure 15:
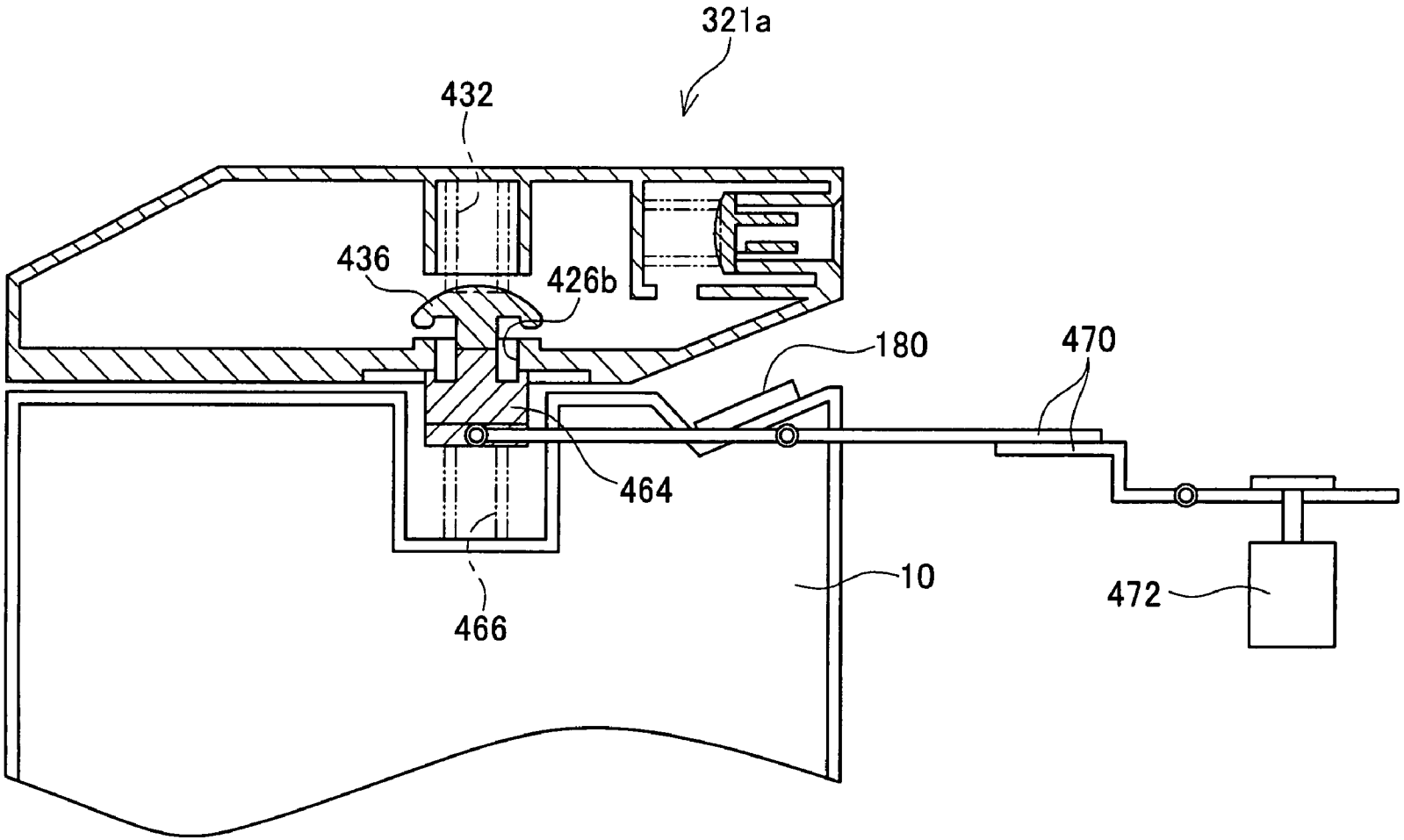
FIG. 15 shows a state where the ink cartridge has been connected with a carriage.

FIG. 15 shows a state where the ink cartridge 321*a* is attached to the carriage 10. When the ink cartridge 321*a* has been attached to the carriage 10, a solenoid 472 is in an OFF state. At this juncture, a connecting member 464 is maintained upwards by the energizing force of a spring 466. The connecting member 464 pushes the cap 436, thus opening the hole 426*b*. In this state, the ink jet head 12 (see FIG. 11) can use the ink of the ink cartridge 321*a*. Further, the connecting member 464 passes through the hole 426*b* and thus fixes the position of the ink cartridge 321*a*. The ink cartridge 321*a* can thus be prevented from moving to the left or right.

In the first embodiment, the ink remaining-amount sensor 180 is disposed at the upper left of the carriage 10. In the present embodiment, however, the ink remaining-amount sensor 180 is disposed at the upper right of the carriage 10.

Figure 16:
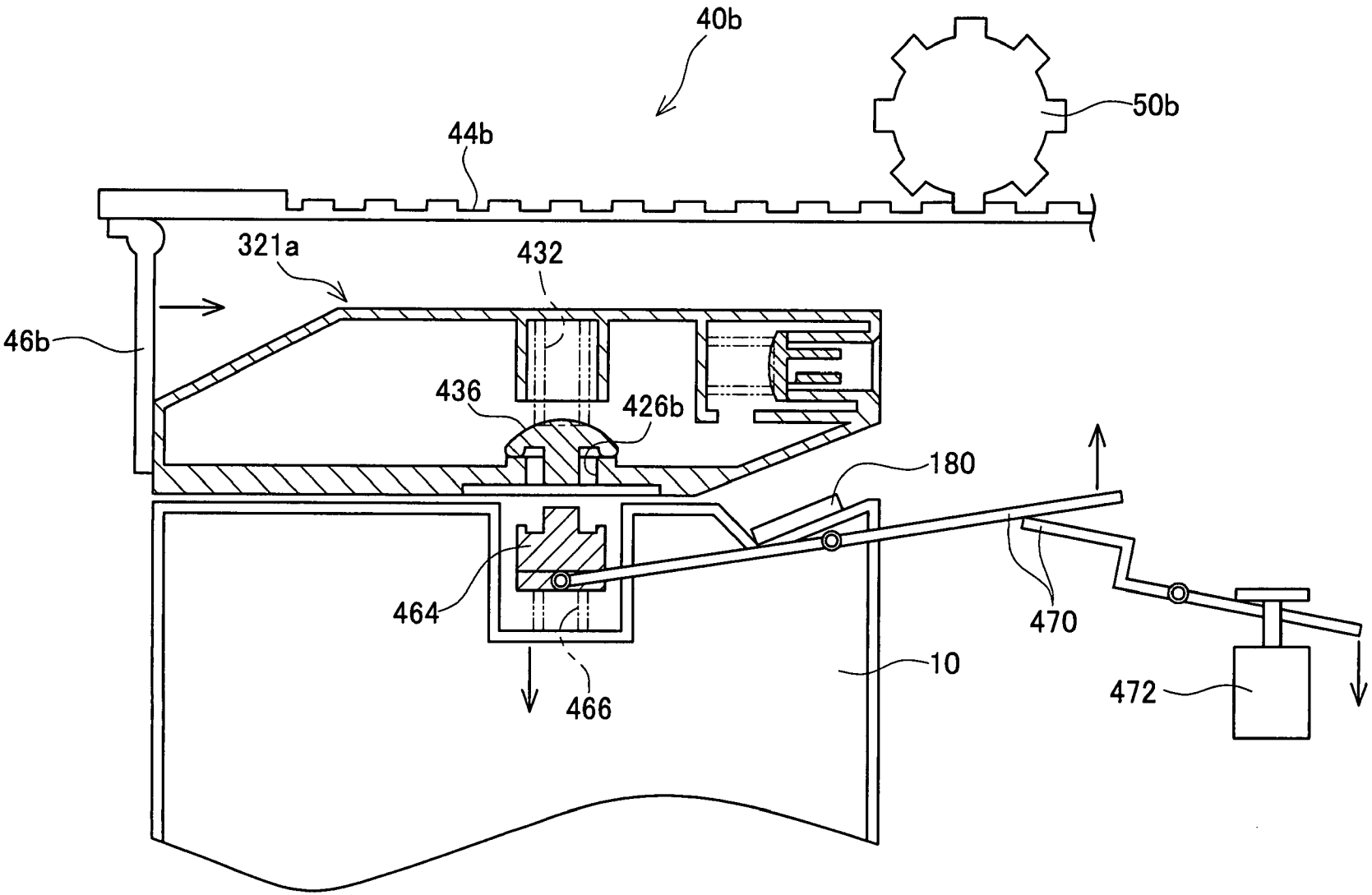
FIG. 16 shows a state where the ink cartridge has been disconnected from the carriage.

In the case where the ink remaining-amount sensor 180 detects that the remaining amount of ink is below the predetermined amount, the CPU 202 (see FIG. 10) of the controller 200 moves the carriage 10 to a position close to the second support device 54. Then, as shown in FIG. 16, the solenoid 472 is tuned ON When the solenoid 472 is turned ON, a link 470 pushes the connecting member 464 downwards. When the connecting member 464 moves downwards, the connecting member 464 sees from the ink cartridge 321*a*. The cap 436 thus closes the hole 426*b*.

Next, the controller 200 causes the pinion shaft 50*b* to rotate in a counterclockwise direction. The rack member 44*b* moves towards the right and the contacting member 46*b* that is connected with the rack member 44*b* pushes the ink cartridge 321*a* towards the right. The used ink cartridge 321*a* is thus transferred to the second support device 54. The used ink cartridge 321*a* is supported by the second support device 54.

Figure 17:
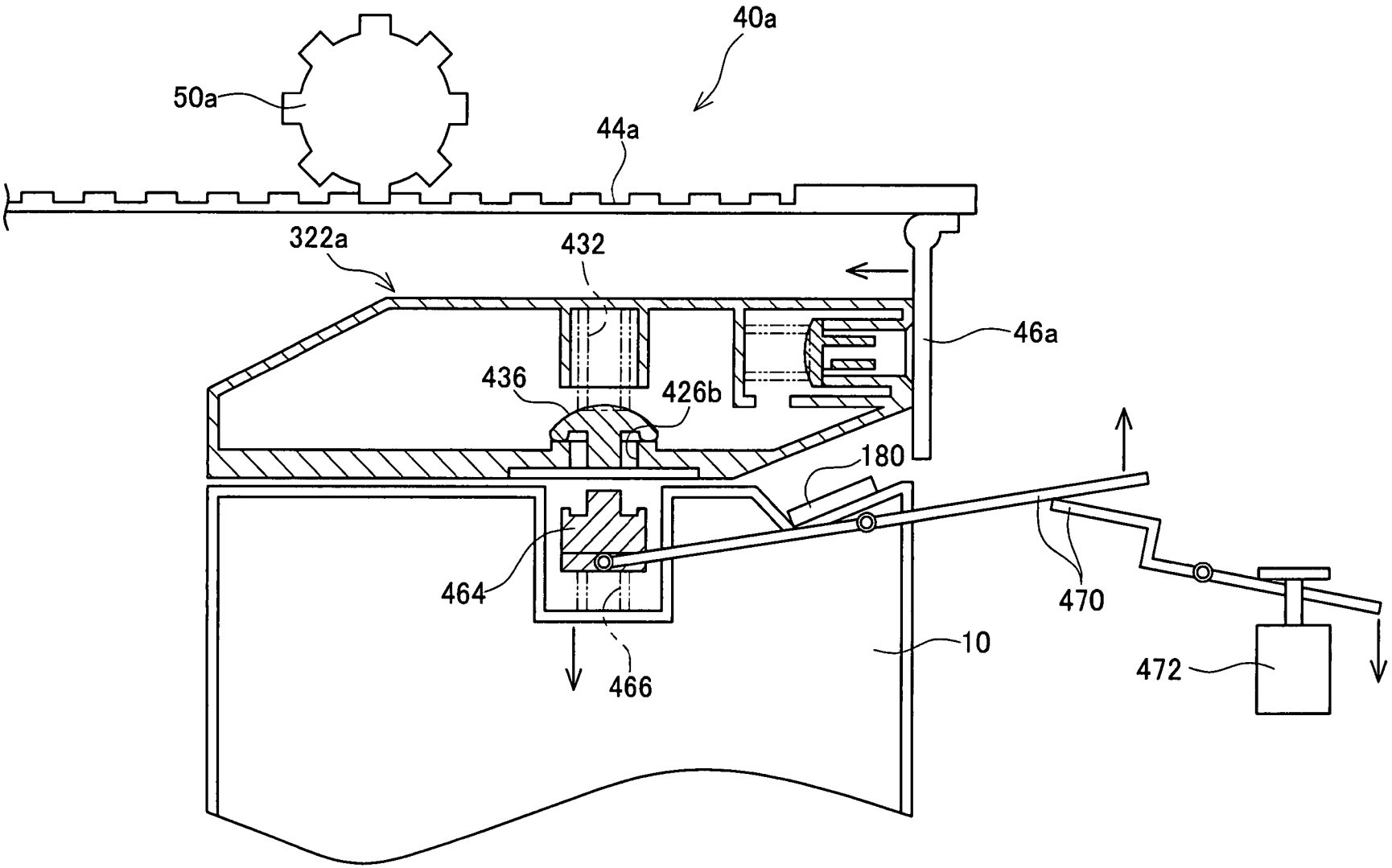
FIG. 17 shows a state where the ink cartridge is connected with the carriage.

Next, the controller 200 moves the carriage 10 to a position close to the first support device 52. Then, as shown in FIG. 17, a pinion shaft 50*a* is rotated in a clockwise direction. A rack member 44*a* thus moves towards the left, and the contacting member 46*a* that is connected with the rack member 44*a* pushes the uppermost spare ink cartridge 322*a*, which was being supported by the first support device 52, towards the left. The spare ink cartridge 322*a* is thus transferred to the carriage 10. FIG. 17 shows the spare ink cartridge 322*a* being supported by the carriage 10. In this state, the solenoid 472 is in an ON state, and the connecting member 464 is maintained downwards. The controller 200 turns the solenoid 472 from ON to OFF, and the connecting member 464 thus moves upwards. The cap 436 is opened, and the printing operation can be executed using the ink from the ink cartridge 322*a*.

In the second embodiment, the first support device 52 and the second support device 54 are aligned in the direction of movement of the carriage 10. As a result, the longitudinal width of the printer 1 (its width in the direction perpendicular to the direction of movement of the carriage 10) can be reduced. The printer 1 of the second embodiment is also extremely useful.

Variants of the aforementioned embodiments may be used. For example, a serial type ink jet printer has been described in the aforementioned representative embodiments. However, the technique taught in the present specification can also be applied to a line type ink jet printer.

What is claimed is:

1. An ink jet printer, comprising:

an ink jet head to which an ink cartridge storing ink is to be connected, wherein the ink jet head discharges the ink supplied from the ink cartridge connected to the ink jet head;

a first support device capable of supporting a plurality of spare ink cartridges such that the plurality of spare ink cartridges is aligned in a direction in which the ink is discharged from the ink jet head and that a first of said plurality of spare ink cartridge is stacked on top of a second of said plurality of spare ink cartridges; and a connecting device that disconnects the ink cartridge connected to the ink jet head from the ink jet head, and connects one of the spare ink cartridges supported by the first support device to the ink jet head, wherein the first support device is located in a space offset from the ink jet head within a plane perpendicular to the direction in which the ink is discharged.

2. The ink jet printer as in claim 1, further comprising;

a carriage capable of moving with respect to a print medium, and capable of supporting the ink jet head and the ink cartridge connected to the ink jet head.

3. The ink jet printer as in claim 2, wherein the ink jet head, the carriage, and the ink cartridge connected to the ink jet head are aligned in the direction in which the ink is discharged.

4. The ink jet printer as in claim 1, wherein the direction in which the ink is discharged is vertical.

5. The ink jet printer as in claim 4, further comprising:

a carriage capable of moving with respect to a print medium, and capable of supporting the ink jet head and the ink cartridge connected to the ink jet head, wherein the first support device supports the plurality of spare ink cartridges within a space lower than or equal to a height of the ink cartridge connected to the ink jet head.

6. The ink jet printer as in claim 4, wherein the first support device is capable of supporting the plurality of spare ink cartridges such that the plurality of spare ink cartridges are stacked vertically.

7. The ink jet printer as in claim 6, further comprising:

a first contacting member that makes contact with an upper face of one of the spare ink cartridges located at an uppermost position within a stack of the spare ink cartridges, wherein the first support device comprises:

a first table capable of supporting the spare ink cartridges on an upper face thereof; and a first energizing member that energizes the first table upward.

8. The ink jet printer as in claim 1, further comprising;

a second support device capable of supporting a plurality of used ink cartridges such that the plurality of used ink cartridges is aligned in the direction in which the ink is discharged, wherein the second support device is located in a space offset from the ink jet head and the first support device within the plane perpendicular to the direction in which the ink is discharged.

9. The ink jet printer as in claim 8, wherein the direction in which the ink is discharged is vertical.

10. The ink jet printer as in claim 9, further comprising;

a carriage capable of moving with respect to a print medium, and capable of supporting the ink jet head and the ink cartridge connected to the ink jet head, wherein the second support device supports the plurality of used ink cartridges within a space lower than or equal to a height of the ink cartridge connected to the ink jet head.

11. The ink jet printer as in claim 9, wherein the second support device is capable of supporting the plurality of used ink cartridges such that the plurality of used ink cartridges are stacked vertically.

12. The ink jet printer as in claim 11, further comprising;

a second contacting member that makes contact with an upper face of one of the used ink cartridges located at an uppermost position within a stack of the used ink cartridges, wherein the second support device comprises:

a second table capable of supporting the used ink cartridges on an upper face thereof; and a second energizing member that energizes the second table upward.

13. The ink jet printer as in claim 8, further comprising;

a carriage configured to move with respect to a print medium, and configured to support the ink jet head and the ink cartridge connected to the ink jet head, wherein the connecting device is configured to perform a first transferring action such that the ink cartridge being supported by the carriage is able to be disconnected from the carriage and is able to be moved to the second support device, and a second transferring action such that one of the spare ink cartridges being supported by the first support device is able to be moved from the first support device to the carriage while being supported by the carriage.

14. The ink jet printer as in claim 13, wherein the carriage is capable of being positioned between the first support device and the second support device, and the connecting device simultaneously performs the first transferring action and the second transferring action while the carriage is positioned between the first support device and the second support device.

15. The ink jet printer as in claim 13, wherein the first support device and the second support device are aligned in a direction along which the carriage moves.

16. The ink jet printer as in claim 13, wherein each ink cartridge has a first inclined plane between an anterior face and a lower face, the anterior face facing a moving direction of the ink cartridge during the first transferring action and/or the second transferring action.

17. The ink jet printer as in claim 16, wherein each ink cartridge has a second inclined plane between a posterior face and an upper face.

* * * * *